US005673599A

United States Patent [19]

Byers et al.

[11] Patent Number: 5,673,599

[45] Date of Patent: Oct. 7, 1997

[54] DOUBLE-ENDED SHARPENING AND DEBURRING TOOL

[76] Inventors: Gary L. Byers; Timothy W. Byers, both of P.O. Box 550, Whitefish, Mont. 59937

[21] Appl. No.: 589,551

[22] Filed: Jan. 22, 1996

Related U.S. Application Data

[63] Continuation-in-part of Ser. No. 285,706, Aug. 4, 1994, Pat. No. 5,488,885.

[51] Int. Cl.[6] ..... B21K 11/00

[52] U.S. Cl. ..... 76/86

[58] Field of Search ..... 76/82, 86–89; 51/496, 557, 558

[56] References Cited

U.S. PATENT DOCUMENTS

| | | | |
|---|---|---|---|
| 1,061,708 | 5/1913 | Vollmer | 76/86 |
| 2,114,364 | 4/1938 | Kilbride et al. | 76/87 X |
| 4,599,919 | 7/1986 | Fortenberry | 76/86 |
| 5,291,805 | 3/1994 | Byers et al. | 76/88 |

*Primary Examiner*—Douglas D. Watts
*Attorney, Agent, or Firm*—Harry M. Cross, Jr.

[57] ABSTRACT

A hand-held sharpener tool for a knife or similar implement comprises a unitary body having first and second end sections and a third mid section, processing elements such as sharpening, deburring or whetting elements mounted in the first and second sections. The third section is located between the processing elements of the first and second end sections and comprises an elongated handle on an upper side of the body, and an elongated blade guide and hand guard extending inwardly of the processing elements, the handle and the hand guard forming an elongated ring rearward of the processing elements with sufficient space for a user's fingers to extend between the handle and the hand guard, and the blade guide depending from the hand guard. The processing elements can be provided to sharpen/deburr either a two-sided blade such as a knife blade or a one-sided blade such as a scissors blade. One of the sets of processing elements can be provided as whetting elements to whet a sharpened blade. A fish hook whetstone can be applied to the outer surface of the blade guide.

18 Claims, 1 Drawing Sheet

10
18
24'
22c'
22b'
12
24
14
22b
22
22c
20
16
16f
22'
20a'
20'
20b'
16d
16c 10
4
18
24'
24
22
22c
24
22a'
22'
14a
14
20'
30
14a
20
12
16b
16f
32
4

22
20b
20a
20
16c
16d 18
24
14
16
14a
30
32
16a
16b
16e
16f
16c
16d

DOUBLE-ENDED SHARPENING AND DEBURRING TOOL

RELATED APPLICATION

This application is a continuation-in-part of U.S. application Ser. No. 08/285,706, filed Aug. 4, 1994, now U.S. Pat. No. 5,488,885.

FIELD OF THE INVENTION

This invention relates to hand tools and, more particularly, to hand held sharpening and deburring tools.

BACKGROUND OF THE INVENTION

Hand held sharpening and deburring tools have been proposed for home, business, sports, commercial and industrial uses for convergent-edged bladed implements, such as knives, cleavers, hatchets, and the like kind of implements having V-shaped working edges. Hand held tools of this type have been proposed that can accommodate like-structured devices, such as knife-type blades, where sharpening or deburring must occur on two convergent surfaces, and such tools have incorporated hand and finger guards. An exemplary model is disclosed in U.S. Pat. No. 4,418,588 that incorporates a cantilevered guard designed to shield a user's fingers from the blade being sharpened as the tool is drawn along the blade edge. In tools of the type disclosed in U.S. Pat. No. 4,418,588, there is no integrated blade guard that is unitary with the tool handle. This lack of a unitary blade guard and handle causes some user's to be concerned whether they may inadvertently cut themselves when the tool is pulled off the tip of the blade. This concern has resulted in a limiting of the attractiveness of such tools to certain potential users.

SUMMARY OF THE INVENTION

A primary object of the present invention is to provide a double-headed hand-held sharpening/deburring/whetting tool of the type having a unitary body with a unitary handle and finger/hand guard and that incorporates one, or more processing elements with opposite ends being suitable for different sharpening, deburring, and/or whetting operations.

The hand-held sharpener tool of this invention comprises two sets of sharpening/deburring/whetting means, a body mounting such means and providing handle means for gripping the tool so as to apply the sharpening/deburring/whetting means to a blade to be sharpened/deburred/whetted, hand guard means for shielding a user's tool-gripping hand, with the hand guard means shielding the user's tool-gripping hand as the tool is drawn along the blade, and blade guide means for confining and guiding a blade during the sharpening/deburring/whetting process.

A hand-held sharpener tool for a knife or similar implement according to this invention comprises a unitary body having first and second end sections and a third mid section, processing elements such as sharpening or deburring or whetting elements mounted in the first and second sections. The third section is located between the processing elements of the first and second end sections and comprises an elongated handle on an upper side of the body, and an elongated blade guide and hand guard extending inwardly of the processing elements, the handle and the hand guard forming an elongated ring inward of the processing elements with sufficient space for a user's fingers to extend between the handle and the hand guard, and the blade guide depending from the hand guard. The processing elements can be provided to sharpen/deburr/whet either a two-sided blade such as a knife blade or a one-sided blade such as a scissors blade. One of the sets of processing elements can be provided as whetting elements to whet a sharpened blade while the other set of processing elements can be provided as sharpening/deburring elements. A fish hook whetstone can be applied to the outer surface of the blade guide.

DETAILED DESCRIPTION OF THE INVENTION

Figures 1, 2, 3, 4, 5:
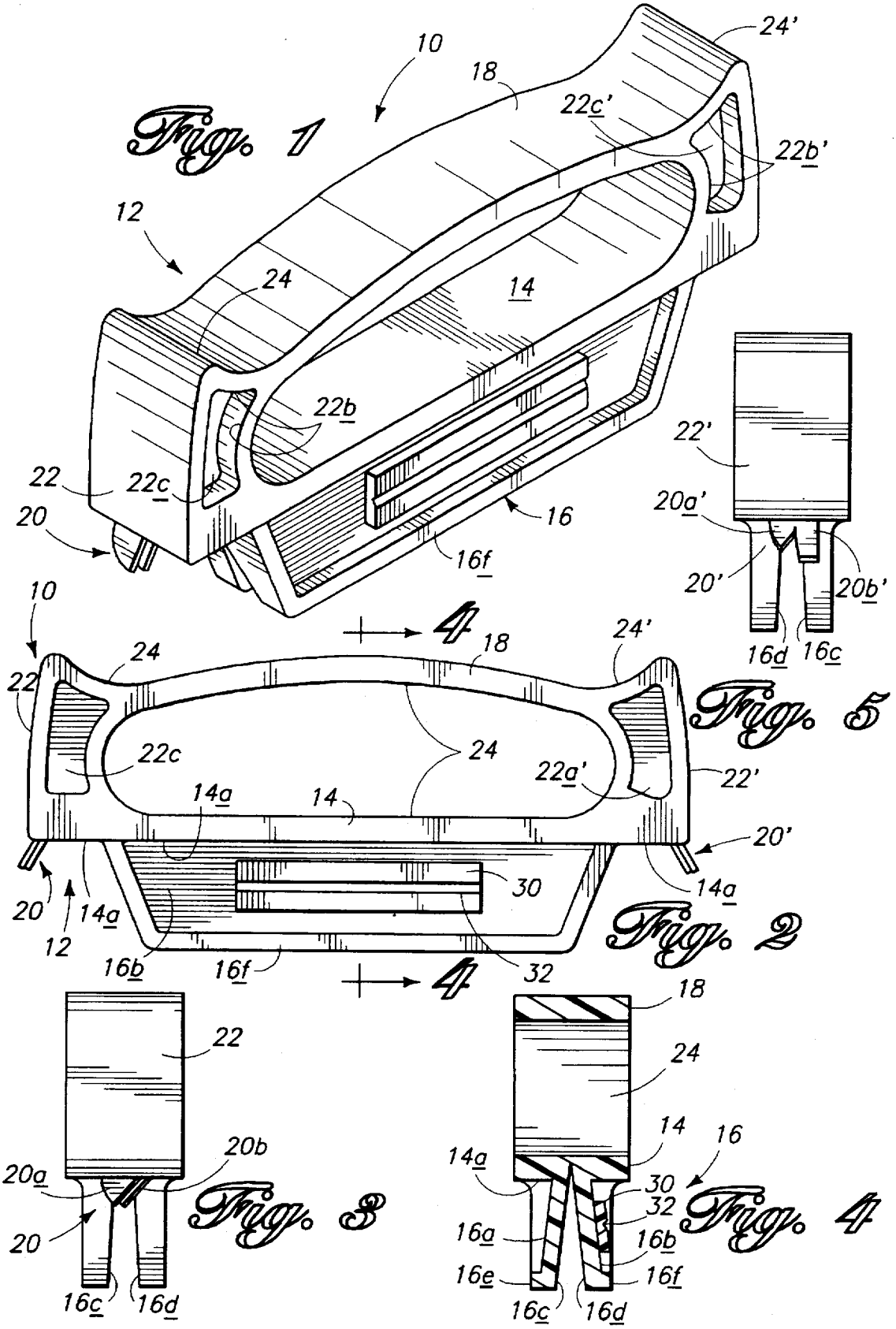
FIG. 1 is a perspective view of one embodiment of the hand held sharpener/deburrer of this invention, this embodiment incorporating an integral blade guide means.
FIG. 2 is a side elevation view of the FIG. 1 tool.
FIG. 3 is a front end view of the FIG. 1 tool further illustrating the placement of two overlapped carbide sharpening/deburring elements.
FIG. 4 is a cross-section view taken along the line 4—4 of FIG. 2.
FIG. 5 is a rear end view of the FIG. 1 tool further illustrating the placement of the overlapped insert elements, one being a sharpened carbide sharpening/deburring element and the other being an unsharpened steel blade guide element.

The tool of this invention preferably comprises a unitary body having a front end section mounting a processing means, a rear end section also mounting a processing means, and a main section incorporating handle means and hand guard means. In the preferred form of the tool body, the body provides a ring section that incorporates the handle means and the hand guard means. The preferred one-piece construction of the tool provides a relatively stiff and inflexible handle and hand/finger guard within the ring configuration. In the preferred form of the tool body, the body provides a ring section that incorporates the handle means and the hand guard means, with the hand guard means located between the handle means and the blade guide means. The tool's blade guide means provides an elongated notch for receiving the blade to be sharpened/deburred/whetted, the base of the notch being adjacent the handle guard means.

The tool body is provided with recesses in a first front-facing section thereof to receive one or more processing inserts (such as sharpening and/or deburring inserts or whetting inserts), recesses in a second rear-facing section thereof to receive one or more such processing inserts, and a third mid section located longitudinally between the first and second sections. The recesses at each end are adapted to receive insert members in a generally transverse position with respect to the longitudinal axis of the body. A set of sharpening and/or deburring and/or whetting insert members are positioned within the body recesses; a front set for the first section and a rear set for the second section.

The insert members of each set comprise first and second insert members. The first insert member may have a ground surface providing at least one sharpening and/or deburring edge, ande be positioned within the body recesses such that its ground surface is oriented toward the outer end of the frontal section at an obtuse angle with respect to the longitudinal axis of the body. The second insert member may have an edge complementary to the first insert's ground-surfaced edge, and be positioned within the body recesses such that it partially overlays the second insert member in abutting contact therewith and such that its complementary is oriented at an obtuse angle with respect to the longitudinal axis of the body. The second insert's complementary edge may be provided with a ground surface, in which case the tool would be adapted to sharpen/deburr V-shaped blades such as knife blades that must be sharpened on two sides. Alternately, the second insert's complementary edge may be provided with an unground surface, in which case the tool would be adapted to sharpen/deburr single-edged blades such as scissors blades, most garden tools, pruners and shears, and the like, which must be sharpened on one side only. Alternately, both inserts may be provided as whetting elements such as ceramic or whetstone elements to whet a sharpened blade edge. The edges of the first and second insert members are convergent whereby an object to be sharpened or deburred may be inserted between their convergent surfaces for sharpening and/or deburring and/or whetting.

Insert retaining means may be detachably secured to the body at one or both ends and adapted to contact one of the insert members and to apply a sufficient force to that insert member whereby the first and second insert members are restrained from movement within the body recesses. However, it is preferred to incorporate the insert members integrally into the body so that separate insert retaining means are unnecessary.

The hand held sharpening/deburring tool 10 of this invention, as depicted in FIGS. 1–4, comprises (a) a unitary body 12 having a hand/finger guard section 14, a blade guide section 16, and a handle grip section 18; and (b) sharpening/deburring/whetting insert members 20, 20' fastened to the body 12. The front end section 22 of body 12 mounts the insert members 20 and also provides a thumb rest 24 above the insert mounting. The rear end section 22' of body 12 mounts the insert members 20' and also provides a thumb rest 24' above the insert mounting. Thus, the insert mountings and the thumb rests are located both forwardly and rearwardly of the handle grip section 18, the blade guide section 16, and the hand/finger guard section 14. Consequently, the tool is double-ended in that a user's thumb may be rested on thumb rest 24' to apply the sharpening/deburring/whetting insert members 20, or a user's thumb may be rested on thumb rest 24' to apply the sharpening/deburring/whetting insert members 20'.

The main part of the body 12 is formed as a flattened ring, longitudinally elongated. The upper part of this flattened ring provides the handle grip section 18 and the bottom part provides the hand/finger guard section 14. The handle grip section 18 and the hand/finger guard section 14 are. generally rectangular in cross-section as can be seen in FIG. 7. The interior 24 of this flattened ring is long enough and high enough to accommodate a user's fingers when the user wraps his/her fingers around the upper part in a gripping fashion. Gripping the ring thusly naturally places the user's thumb on the thumb rest 24 or 24', and the bottom part naturally forms the finger/hand guard.

The blade guide section 16 depends from the finger/hand guard section 14. Section 16 comprises a pair of depending walls **16*a*, 16*b* that have interior, facing surfaces 16*c*, 16*d* that are upwardly convergent (i.e. surfaces 16*c*, 16*d* are inverted V-shaped in cross-section as can be seen in FIG. 7). The periphery of each wall, 16*a*, 16*b*, is rimmed with an laterally-outward extending reinforcing edge, 16*e*, 16*f*, and the walls consist of webs extending between the finger/hand guard 14 and the reinforcing edges 16*e* (in the case of wall 16*a*), 16*f* (in the case of wall 16*b***).

The sharpening/deburring/whetting inserts 20 may be rectangularly shaped flat members made of appropriate material such as tungsten carbide or the like as shown in FIG. 3. Each blade has a ground face to be employed in a sharpening/deburring process. With respect to inserts 20 the ground faces are intersected and overlayed as shown to provide convergent sharpening/deburring working edges that define a V-shaped notch. The ground faces of inserts 20 may be beveled at about 5 degrees so that the faces themselves lie in convergent planes. Therefore, the cutting edge of a knife or like device may be rested upon the working edges of inserts 20 and tool 10 drawn therealong to sharpen or deburr the cutting edge. The outside front corners of inserts 20 may be rounded as shown in FIG. 3.

The inserts 20 are received in overlying abutting relationship and held in such relationship as a result of being secured within the body 12. This may be accomplished by molding the body 12 around the inserts or by fastening the inserts into a slot provided in the body 12. If it is desired to make the inserts replaceable, the front end section 22 could be appropriately modified to accommodate an insert retainer that would detachably secure the inserts to the front end section 22. Such an insert retainer could be formed to position and hold the inserts 20 in the proper overlapped and aligned position shown in the drawings.

The sharpening/deburring/whetting inserts 20' may be rectangularly shaped flat members made of appropriate material, one insert **20*a'* being fabricated from a material such as tungsten carbide or the like, and the other insert 20*b'* being fabricated from a material such a steel or the like. Insert 20*a'* has a ground face to be employed in a sharpening/deburring process. Insert 20*b'* has an unsharpened face complementary to the ground face of insert 20*a'* to provide a guide surface for a scissors blade or a like blade. With respect to inserts 20' the faces are intersected and overlayed as shown in FIG. 5 to provide convergent edges that define a V-shaped notch, one such surface on insert 20*a'* being a working edge for sharpening/deburring the beveled aspect of a scissors-type blade, and the other such surface on insert 20*b'* being a guide edge to position a scissors-type blade in proper position relative to insert 20*a'*. The faces of inserts 20' may be beveled at about 5 degrees so that the faces themselves lie in convergent planes. Therefore, the cutting edge of a scissors or like device may be rested upon the working edges of inserts 20' and tool 10 drawn therealong to sharpen or deburr the cutting edge. The outside front corner of insert 20*a'* may be rounded as shown in FIG. 5. The front corners of insert 20*a'* could be eased, as opposed to being rounded, and the front end of insert 20*b'* preferably protrudes beyond the front end of insert 20*a'* to shield the sharp inside front corner of insert 20*a'* as shown in FIG. 5**.

When in use, the tool 10, of the embodiment, is placed over a blade, such as knife blade, with the webs **16*a*, 16*b* of the blade guard 16 disposed on either side of the blade 40. As can be seen in FIG. 4, the inverted V-shaped notch of the blade guide will guide the blade edge into the proper relationship with the inserts 20 for sharpening/deburring. The V-shaped notch, defined by the inner surfaces 16*c*, 16*d* of the webs 16*a*, 16*b*, is longitudinally elongated, underlying and extending substantially the full length of the flattened ring of body 12. The bottom of the notch is located at the base of the finger/hand guard 14 so that the knife blade edge will be guided longitudinally through the sharpening/deburring inserts 20, just below the finger/hand guard 14. The inserts 20 extend forwardly and outwardly at an obtuse angle from the front end section 22 so that they will form an acute angle with respect to the blade edge to be sharpened/deburred. In operation, the blade being sharpened/deburred is shielded from the user's hand and, when the tool is pulled beyond the tip of the blade, the front end section 22** continues to shield the user's knuckles and thumb.

Alternately, when in use, the tool 10, may be placed over a scissors-type blade. The tool would be reversed from the condition previously described so that a user's thumb would be rested on thumb rest 24'. The inserts 20' then extend forwardly and outwardly at an obtuse angle from the end section 22' so that they will form an acute angle with respect to the blade edge to be sharpened/deburred. In operation, the blade being sharpened/deburred is shielded from the user's hand by the base 14*a*, or underside, of the hand/finger guard section 14 and, when the tool is pulled beyond the tip of the blade, the front end section 22 continues to shield the user's knuckles and thumb. The base 14*a* provides a flat, linear surface that extends between the end surfaces 22*a* of end section 22 and 22*a'* of end section 22'.

A preferred tool 10 is fabricated from injection-molded plastic, with a width of about 0.75 in., a length of about 4.75 in. and a height of about 2 in. The inverted V-shaped notch of the blade guide has a depth of about 0.75 in. The thickness of the rim of the flattened ring is about ⅛ in. and the thickness of the blade guide webs is also about ⅛ in.

Because of the one-piece construction and ring configuration, the hand/finger guard section 14 is relatively rigid and inflexible. The base 14*a*, extending substantially the full length of the tool provides a solid, inflexible barrier between a user's hand/fingers and the blade to be sharpened. Moreover, because the base 14*a* extends from the end surface 22*a* to the end surface 22*a'*, the tool can be placed on a blade to be sharpened with the base 14*a* in contact with the blade as the tool is drawn along the blade during the sharpening process without endangering the user's hand/fingers. Consequently, a user will feel more secure in using this tool compared to using a tool of the prior art type which employs a flexible hand/finger guard that might flex or bend if contacted by the blade during a sharpening process.

The end sections 22, 22' are each bounded by a rib and the center portion so bounded is filled with a web. The rib 22*b*, 22*b'* is about ⅛ in. thick and the center portion 22*c*, 22*c'* is about ¼ in. thick. The center portion 22*c*, 22*c'* is aligned along the center line of the tool 10 so that there is a recess on each side of the web about ⅛ in. deep. The wall of the end sections 22, 22', adjacent to the inserts 20, 20', is thicker than the boundary rib 22*b*, 22*b'* so that there is sufficient material surrounding the embedded portions of the inserts 20, 20' to hold them firmly in place.

One or both sides of the blade guard 16 may also be provided with a sharpening stone or whetstone or ceramic or diamond rectangular element 30 having a longitudinal sharpening slot 32 therein for sharpening or deburring articles such as fish hooks. The stone 30 is secured by a suitable adhesive to the outer surface of one of the guard webs, such as web 16*b* shown in FIG. 4. The thickness of the stone 30 may be such that it will not protrude beyond the guard rim 16*f* and will therefore be adequately protected by rim 16*f*.

One or the other set of inserts 20. 20' may be provided as a pair of whetting elements, such as ceramic elements or whetstone elements, rather than steel or carbide elements. If so provided, one set of elements, such as 20, could be carbide elements to sharpen an implement, and the other set of elements, such as 20', could be ceramic elements to whet a sharpened edge of the implement.

While the preferred embodiments of the invention have been described herein, variations in the design may be made. The scope of the invention, therefore, is only to be limited by the claims appended hereto.

The embodiments of the invention in which an exclusive property is claimed are defined as follows:

1. A hand-held sharpener tool for sharpening blades which comprises a unitary body having first and second end sections and a third section between said first and second end sections; first and second sets of sharpening or whetting means each mounted in one of said first and second end sections; said sharpening means of said first set comprising first and second insert members, the first insert member being provided with a sharpening/deburring edge, and the second insert member being provided with a complementary edge partially overlaying said sharpening/deburring edge so as to form therewith a V-shaped notch so that said tool may sharpen and deburr a single-sided blade edge; said third section being located between said sharpening means and comprising an elongated handle on an upper side of said body extending between said first and second sections, and an elongated hand guard on a lower side of said body extending between said first and second sections; said body being so constructed and arranged that said handle and said blade hand guard are integrally joined together at respective ends thereof to form a ring that incorporates both said handle and said hand guard so that a user's fingers may be extended through said ring to grip said handle and may be shielded by said hand guard.

2. A hand-held sharpener tool for sharpening blades which comprises a unitary body having first and second end sections and a third section between said first and second end sections: first and second sets of sharpening or whetting means each mounted in one of said first and second end sections; said sharpening means of said first set comprises comprising first and second insert members, the first insert member being provided with a sharpening/deburring edge, and the second insert member being provided with a complementary edge partially overlaying said sharpening/deburring edge so as to form therewith a V-shaped notch so that said tool may sharpen and deburr a double-sided blade edge; said third section being located between said sharpening means and comprising an elongated handle on an upper side of said body extending between said first and second sections, and an elongated hand guard on a lower side of said body extending between said first and second sections: said body being so constructed and arranged that said handle and said blade hand guard are integrally joined together at respective ends thereof to form a ring that incorporates both said handle and said hand guard so that a user's fingers may be extended through said ring to grip said handle and may be shielded by said hand guard.

3. A hand-held sharpener tool for sharpening blades which comprises a unitary body having first and second end sections and a third section between said first and second end sections: first and second sets of sharpening or whetting means each mounted in one of said first and second end sections; said sharpening means of said second set comprising first and second insert members mounted so as to protrude from said flat surface adjacent to said second end surface, the first insert member being provided with a sharpening/deburring edge, and the second insert member being provided with a complementary edge partially overlaying said sharpening/deburring edge so as to form therewith a V-shaped notch so that said tool may sharpen and deburr a single-sided blade edge; said sharpening means of said first set comprising first and second insert members mounted so as to protrude from said flat surface adjacent to said second end surface, the first insert member being provided with a sharpening/deburring edge, and the second insert member being provided with a complementary edge partially overlaying said sharpening/deburring edge so as to form therewith a V-shaped notch so that said tool may sharpen and deburr a double-sided blade edge; said third section being located between said sharpening means and comprising an elongated handle on an upper side of said body extending between said first and second sections, and an elongated hand guard on a lower side of said body extending between said first and second sections; said body being so constructed and arranged that said handle and said blade hand guard are integrally joined together at respective ends thereof to form a ring that incorporates both said handle and said hand guard so that a user's fingers may be extended through said ring to grip said handle and may be shielded by said hand guard.

4. A hand-held sharpener tool for sharpening blades which comprises a unitary body having first and second end sections and a third section between said first and second end sections; first and second sets of sharpening or whetting means each mounted in one of said first and second end sections; said sharpening means of said first set comprising first and second insert members, the first insert member being provided with a sharpening/deburring edge, and the second insert member being provided with a complementary edge partially overlaying said sharpening/deburring edge so as to form therewith a V-shaped notch so that said tool may sharpen and deburr a blade edge; said sharpening means of said second set comprising whetting elements one overlaying the other so as to form a V-shaped notch so that said tool may whet a sharpened blade edge; said third section being located between said sharpening means and comprising an elongated handle on an upper side of said body extending between said first and second sections, and an elongated hand guard on a lower side of said body extending between said first and second sections; said body being so constructed and arranged that said handle and said blade hand guard are integrally joined together at respective ends thereof to form a ring that incorporates both said handle and said hand guard so that a user's fingers may be extended through said ring to grip said handle and may be shielded by said hand guard.

5. A hand-held sharpener tool for sharpening blades which comprises a unitary body having first and second end sections and a third section between said first and second end sections; first and second sets of sharpening or whetting means each mounted in one of said first and second end sections; said third section being located between said sharpening means and comprising an elongated handle on an upper side of said body extending between said first and second sections, and an elongated hand guard on a lower side of said body extending between said first and second sections; said body being so constructed and arranged that said handle and said blade hand guard are integrally joined together at respective ends thereof to form a ring that incorporates both said handle and said hand guard so that a user's fingers may be extended through said ring to grip said handle and may be shielded by said hand guard; hand guard means extended between said first and second end sections for shielding a user's tool-gripping hand; and blade guide means extended between said first and second end sections; said blade guide means being constructed and arranged to provide a blade-receiving channel juxtaposed to said sharpenihg means and extended along said hand guard means so that a blade to be sharpened can be placed in said blade-receiving channel so as to locate the blade relative to said sharpening means and confine the blade as said tool is drawn along the blade; and said blade guide means and said hand guard means being constructed and arranged to locate said hand guard means between said handle grip section and said blade-receiving channel so that a user's fingers may be wrapped around said handle grip section with the tool-gripping hand being separated from said blade-confining channel by said hand guard means when said tool is applied to a blade to be sharpened and the blade is drawn through said sharpening means and through said blade-receiving channel.

6. The tool of claim 5 wherein said body provides an enclosed ring section that incorporates said handle means and said hand guard means, said handle means and said hand guard means being further constructed and arrange so that an elongated ring interior is defined having a length and height sufficient to accommodate a user's fingers when a user grips said handle grip section.

7. The tool of claim 5 said blade guide means comprise walls having sloped inner surfaces that define an elongated and inverted V-shaped blade-receiving notch, the base of said notch being adjacent said hand guide, and wherein said walls are provided with peripheral edge-reinforcing rims extended around therearound and terminated in said hand guard so that said walls constitute webs extended from said hand guard that are bounded by said rims.

8. The tool of claim 5 wherein said blade guide means provides said blade-receiving channel in the form of an elongated V-shaped notch for receiving a blade to be sharpened, the base of said notch being adjacent said handle guard means.

9. The tool of claim 7 including whetting means mounted to an outer surface of a blade guide wall and facing outward so as to provide a whetting surface for whetting fish hooks.

10. The tool of claim 1 wherein said ring is flattened and elongated to provide a ring interior having a length and height sufficient to accommodate several fingers of a user's hard when a user grips said handle.

11. The tool of claim 10 wherein said body is provided with a flat surface that extends from a first end surface of said first end section and along the base of said hand guard to a second end surface of said second end section, said first and second end sections and said hand guard being so constructed that said flat surface is relatively stiff and inflexible.

12. The tool of claim 2 wherein said ring is flattened and elongated to provide a ring interior having a length and height sufficient to accommodate several fingers of a user's hand when a user grips said handle.

13. The tool of claim 12 wherein said body is provided with a flat surface that extends from a first end surface of said first end section and along the base of said hand guard to a second end surface of said second end section, said first and second end sections and said hand guard being so constructed that said flat surface is relatively stiff and inflexible.

14. The tool of claim 3 wherein said ring is flattened and elongated to provide a ring interior having a length and height sufficient to accommodate several fingers of a user's hand when a user grips said handle.

15. The tool of claim 14 wherein said body is provided with a flat surface that extends from a first end surface of said first end section and along the base of said hand guard to a second end surface of said second end section, said first and second end sections and said hand guard being so constructed that said flat surface is relatively stiff and inflexible.

16. The tool of claim 4 wherein said ring is flattened and elongated to provide a ring interior having a length and height sufficient to accommodate several fingers of a user's hand when a user grips said handle.

17. The tool of claim 16 wherein said body is provided with a flat surface that extends from a first end surface of said first end section and along the base of said hand guard to a second end surface of said second end section, said first and second end sections and said hand guard being so constructed that said flat surface is relatively stiff and inflexible.

18. The tool of claim 5 including whetting means mounted to said blade guide means and facing outward so as to provide a whetting surface for whetting fish hooks.

* * * * *